US007906458B2

(12) United States Patent
Matsunaga et al.

(10) Patent No.: US 7,906,458 B2
(45) Date of Patent: Mar. 15, 2011

(54) HEAT-SENSITIVE RECORDING MATERIAL AND PRODUCTION METHOD THEREOF

(75) Inventors: Yoshiaki Matsunaga, Numazu (JP); Shinji Takano, Numazu (JP); Kazuyuki Uetake, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 852 days.

(21) Appl. No.: 11/901,151

(22) Filed: Sep. 13, 2007

(65) Prior Publication Data

US 2008/0146443 A1 Jun. 19, 2008

(30) Foreign Application Priority Data

Sep. 15, 2006 (JP) ..... 2006-251298

(51) Int. Cl.
*B41M 5/42* (2006.01)

(52) U.S. Cl. ..... 503/226; 503/200

(58) Field of Classification Search ..... None
See application file for complete search history.

(56) References Cited

U.S. PATENT DOCUMENTS

| | | | |
|---|---|---|---|
| 5,457,080 | A | 10/1995 | Takano et al. |
| 6,271,300 | B1 | 8/2001 | Ohsumi et al. |
| 2003/0039917 | A1 | 2/2003 | Naruse et al. |
| 2006/0063013 | A1 | 3/2006 | Ikeda et al. |
| 2006/0159913 | A1 | 7/2006 | Kugo et al. |
| 2007/0184978 | A1 | 8/2007 | Takano et al. |
| 2007/0225164 | A1 | 9/2007 | Kajikawa et al. |

FOREIGN PATENT DOCUMENTS

| | | |
|---|---|---|
| EP | 1243439 A1 | 9/2002 |
| JP | 6-270538 | 9/1994 |
| JP | 8-118808 | 5/1996 |
| JP | 8-151412 | 6/1996 |
| JP | 10-87936 | 4/1998 |
| JP | 11-314457 | 11/1999 |
| JP | 2001-270250 | 10/2001 |
| JP | 2002-283717 | 10/2002 |
| JP | 2004-160862 | 6/2004 |

OTHER PUBLICATIONS

European search report in connection with corresponding European patent application No. 07 11 6488.

*Primary Examiner* — Bruce H Hess
(74) *Attorney, Agent, or Firm* — Cooper & Dunham LLP

(57) ABSTRACT

To provide a heat-sensitive recording material, including: a substrate; a heat-sensitive color developing layer on the substrate, the heat-sensitive color developing layer containing at least a leuco dye and a developer; and a protective layer on the heat-sensitive color developing layer, the protective layer containing at least a binder resin, wherein the binder resin in the protective layer contains diacetone-modified polyvinyl alcohol resin, the degree of polymerization of the binder resin in the protective layer is 1,000 to 1,800 and the degree of saponification of the binder resin is 90% or greater and less than 98%.

8 Claims, 1 Drawing Sheet

HEAT-SENSITIVE RECORDING MATERIAL AND PRODUCTION METHOD THEREOF

BACKGROUND OF THE INVENTION

1. Field of the Invention

The present invention relates to a heat-sensitive recording material that is suitably utilized in fields including computer output, printers such as calculators, recorders for medical-purpose measuring instruments, low-speed and high-speed facsimiles, automatic ticket vending machines and handy terminals, and to a production method thereof.

2. Description of the Related Art

Many heat-sensitive recording materials have been proposed that have on a substrate a heat-sensitive color developing layer containing at least a leuco dye and a developer, and utilize color developing reactions between the leuco dye and developer. Advantages of these heat-sensitive recording materials include: (1) absence of necessity to conduct such complicated processing as image development or fixation, enabling short-time recording by means of a relatively simple apparatus; (2) low level of generated noise; and (3) low costs. Thus, they are widely used as recording materials for use in electronic calculators, facsimiles, label printers, recorders, handy terminals, etc., in addition to their application for copying of books and documents.

As the heat-sensitive recording materials, such materials are demanded that are capable of rapid development high-density color, and of imparting rigidity to the color-developed image and background. Recently, such heat-sensitive recording materials have been frequently used in fields where the fidelity of recorded images is important, such as labels. In particular, heat-sensitive recording materials that offer high stability against plasticizers and oils contained in organic polymer materials used in packages are in demand.

To meet these demands, heat-sensitive recording materials where a protective layer is arranged on a heat-sensitive color developing layer are proposed. As binder resin in the protective layer, polyvinyl alcohol, modified polyvinyl alcohol, or a resin where these alcohols and a water resistant additive are combined is used. For example, a combination of diacetone-modified polyvinyl alcohol and a hydrazine compound is proposed (see Japanese Patent Application Laid-Open No. 08-151412). However, the use of this proposed material for a protective layer presents a problem that water-resisting reaction is accelerated when it is applied as a liquid form, and this coating solution for protective layer becomes thicker over time.

Further, another heat-sensitive recording material using diacetone-modified polyvinyl alcohol as a binder resin in the protective layer and containing a hydrazine compound in the heat-sensitive color developing layer is proposed (see JP-A No. 11-314457). However, in this proposal, there is a problem that the water resistance of the protective layer is insufficient; the coating solution for heat-sensitive color developing layer becomes thicker; or color development of the heat-sensitive color developing layer is inhibited by the hydrazine compound.

Further, another heat-sensitive recording material using copolymerized polyvinyl alcohol containing diacetone acrylamide as a single compound; a water-soluble hydrazine compound; and water-soluble amine is proposed (see JP-A No. 10-87936). However, when the proposed material is used as a protective layer, there is a problem that the water-soluble amine adversely affects the heat-sensitive color developing layer, and thereby background color development occurs, pH control becomes difficult, and the liquid thickening is accelerated depending upon the added amount of the water-soluble amine.

As a method for overcoming these problems, for example, it is proposed to combine a reactive carbonyl group-containing polyvinyl alcohol, a hydrazide compound as a crosslinking agent, and a basic filler (see JP-A No. 2002-283717). In this proposal, however, if the protective layer is applied by using a roller blade coater, undulation occurs over the coating surface, with a difference in the deposited amount of protective layer from one position to another. Consequently, barrier properties, such as resistance to a plasticizer or oil, are decreased in regions where the deposited amount on the protective layer is small, and image discoloration occurs in the printed portions. Further, when the surface of the heat-sensitive recording material has been printed with UV ink or flexo alcohol ink, it results in gray scale variations due to undulation over the protective layer.

As a method for preventing the undulation of the protective layer, for example, JP-A No. 06-270538 specifies a relational expression between shear speed and viscosity of the coating solution for protective layer, and states that a coating solution that satisfies this expression causes no coating undulation. However, the physical properties of the coating solution for protective layer, which resulted in the occurrence of coating unevenness, satisfies the expression; thus the proposed expression is unsatisfactory as a condition for coating solution that does not result in coating undulation.

Further, JP-A No. 08-118808 proposes a heat-sensitive recording material where coating uniformity of the protective layer is improved by setting a contact angle on the surface of the heat-sensitive color developing layer at 70° or less. However, the actual contact angle at which coating undulation occurred is 450, satisfying the above-described condition—70° or less. In addition, in this proposal, as a means to reduce the contact angle, a surfactant, filler or a coloring agent with a smaller surface contact angle is contained within the heat-sensitive color developing layer. However, if these additives are added to the heat-sensitive color developing layer, they may adversely affect the quality of the heat-sensitive recording material. For this reason, this method is not sufficient in improving coating unevenness.

Therefore, the current situation is that no heat-sensitive recording material has yet been provided that causes no printing unevenness, excels in such barrier properties as oil resistance and plasticizer resistance and thus offers excellent printability, and no production method for a heat-sensitive recording material has yet been provided that excels in providing a uniform protective layer because of absence of coating undulation upon application of a coating solution for protective layer and thus enables high-speed coating for improved productivity.

BRIEF SUMMARY OF THE INVENTION

The present invention has been accomplished in view of the above-mentioned circumstance, and an object thereof is to solve the problems pertinent in the art and to achieve objects described below. That is, an object of the present invention is to provide a heat-sensitive recording material that causes no printing unevenness, excels in such barrier properties as oil resistance and plasticizer resistance and thus offers excellent printability, and a production method for a heat-sensitive recording material that excels in providing a uniform protective layer because of absence of coating undulation upon application of a coating solution for protective layer and thus enables high-speed coating for improved productivity.

As a result of extensive studies by the inventors to solve the problems, they discovered that the degree of polymerization and the degree of saponification of the binder resin within the coating solution for protective layer participate in the occurrence of undulation over the protective layer under application conditions in the high shear speed region, and that the occurrence of undulation is prevented by reducing both the degree of polymerization and the degree of saponification of the binder resin.

The present invention is based upon the knowledge by the present inventors, and the means to solve the above-mentioned problems are as follows:

What is claimed is:

<1>A heat-sensitive recording material, including: a substrate; a heat-sensitive color developing layer on the substrate, the heat-sensitive color developing layer containing at least a leuco dye and a developer; and a protective layer on the heat-sensitive color developing layer, the protective layer containing at least a binder resin, wherein the binder resin in the protective layer contains diacetone-modified polyvinyl alcohol resin, the degree of polymerization of the binder resin in the protective layer is 1,000 to 1,800 and the degree of saponification of the binder resin is 90% or greater and less than 98%.

<2> The heat-sensitive recording material according to <1>, wherein the degree of polymerization of the binder resin in the protective layer is 1,500 to 1,700 and the degree of saponification of the binder resin is 95% to 97%.

<3> A heat-sensitive recording material, including: a substrate; a heat-sensitive color developing layer on the substrate, the heat-sensitive color developing layer containing at least a leuco dye and a developer; and a protective layer on the heat-sensitive color developing layer, the protective layer containing at least a binder resin, wherein the binder resin of the protective layer contains diacetone-modified polyvinyl alcohol resin, and the shear speed at the inflection point of the viscosity change of a solution containing 13% by mass of solid contents of the binder resin in the protective layer in a high shear speed region in an environment of at 30° C. is $1.0\times10^6$ $sec^{-1}$ or greater.

<4> The heat-sensitive recording material according to any one of <1> to <3>, wherein the heat-sensitive color developing layer contains a binder resin, and the binder resin in the heat-sensitive color developing layer is the same as the binder resin in the protective layer.

<5> The heat-sensitive recording material according to any one of <1> to <4>, wherein a back layer containing at least a binder resin is provided on a substrate surface where no heat-sensitive color developing layer is arranged, and the binder resin of the back layer is the same as the binder resin in the protective layer.

<6> The heat-sensitive recording material according to any one of <1> to <5>, wherein the heat-sensitive recording material is a heat-sensitive recording label that includes a binding agent layer and a separation paper on a surface of the binding agent layer, the binding agent layer being provided on a substrate surface where no heat-sensitive color developing layer is arranged.

<7> The heat-sensitive recording material according to any one of <1> to <5>, wherein the heat-sensitive recording material is a heat-sensitive recording label that includes a heat-sensitive binder layer that exhibits adhesiveness upon heated, the heat-sensitive binder layer being provided on a substrate surface where no heat-sensitive color developing layer is arranged.

<8> The heat-sensitive recording material according to any one of <1> to <5>, wherein the heat-sensitive recording material is a heat-sensitive recording magnetic paper that includes a magnetic recording layer on a substrate surface where no heat-sensitive color developing layer is arranged.

<9> A method for producing a heat-sensitive recording material, including: forming a protective layer by application of a coating solution for protective layer using one of a rod blade method and a roller blade method, wherein the coating solution contains at least a binder resin whose degree of polymerization is 1,000 to 1,800 and degree of saponification is 90% or greater and less than 98%.

<10> The method for producing a heat-sensitive recording material according to <9>, wherein the application speed of the coating solution for protective layer is 500 m/min or greater.

In a first embodiment, the heat-sensitive recording material of the present invention includes a substrate, a heat-sensitive color developing layer containing at least a leuco dye and a developer on the substrate, and a protective layer containing at least a binder resin on the heat-sensitive color developing layer, wherein the binder resin in the protective layer contains diacetone-modified polyvinyl alcohol resin; the degree of polymerization of the binder resin in the protective layer is 1,000 to 1,800; and the degree of saponification of the binder resin is 90% or greater and less than 98%. Thus no printing unevenness occurs, barrier properties such as plasticizer resistance and oil resistance are excellent, and printability becomes excellent.

In a second embodiment, the heat-sensitive recording material of the present invention includes a substrate, a heat-sensitive color developing layer containing at least a leuco dye and a developer on the substrate, and a protective layer containing at least a binder resin on the heat-sensitive color developing layer, wherein the binder resin in the protective layer contains diacetone-modified polyvinyl alcohol, the sheer speed at the inflection point of the viscosity change of a solution containing 13% by mass of the solid content of the binder resin for the protective layer, as measured in the environment of 30° C. and in a high shear speed region, is $1.0\times10^6$ $sec^{-1}$ or greater. Thus, no printing unevenness occurs, barrier properties such as a plasticizer resistance and oil resistance are excellent, and printability becomes excellent.

The method for producing a heat-sensitive recording material of the present invention includes the step of forming a protection layer by application of a coating solution for protective layer containing a binder resin whose degree of polymerization is 1,000 to 1,800 and degree of saponification is 90% or greater and less than 98% by one of a rod blade method and a roller blade method. Thus, no coating undulation occurs upon application of protective layer and the coat uniformity of the protective layer is excellent, and high-speed coating is made possible for improved productivity.

According to the present invention, it is made possible to solve the various problems in the art and to provide a heat-sensitive recording material that causes no printing unevenness, excels in such barrier properties as oil resistance and plasticizer resistance and thus offers excellent printability, and a production method for a heat-sensitive recording material that excels in providing a uniform protective layer because of absence of coating undulation upon application of a coating solution for protective layer and thus enables high-speed coating for improved productivity.

Figure 1:
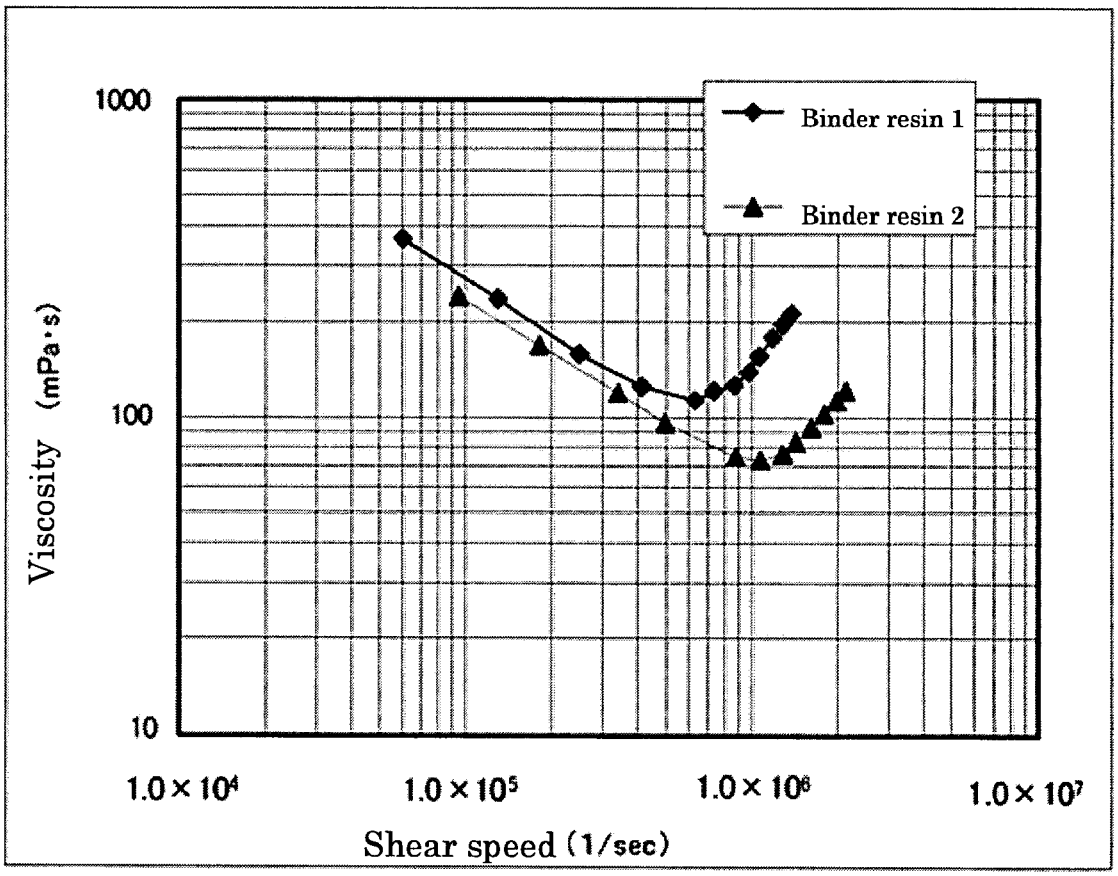
FIG. 1 is a graph showing viscosity measurements of binder resin 1 (diacetone-modified polyvinyl alcohol; degree of polymerization 2,000, degree of saponification=99.0%)

and binder resin 2 (diacetone-modified polyvinyl alcohol; degree of polymerization=1,700, degree of saponification=96.5%) as measured in the high shear speed region.

DETAILED DESCRIPTION OF THE INVENTION (Heat-Sensitive Recording Material)

The heat-sensitive recording material of the present invention has a substrate, a heat-sensitive color developing layer on the substrate, and a protective layer on the heat-sensitive color developing layer, and may contain a back layer, and other layer(s) if necessary.

In the heat-sensitive recording material, in the first embodiment, the binder resin in the protective layer contains diacetone-modified polyvinyl alcohol resin, wherein the degree of the polymerization of the binder resin in the protective layer is 1,000 to 1,800, and the degree of saponification of the binder resin is 90% or greater and less than 98%.

In the heat-sensitive recording material, in the second embodiment, the binder resin in the protective layer contains diacetone-modified polyvinyl alcohol resin, wherein the sheer speed at the inflection point of the viscosity change of a solution containing 13% by mass of the solid content of the binder resin for the protective layer, as measured under the environment of 30° C. and in a high shear speed region, is $1.0\times10^6$ $sec^{-1}$ or greater.

<Protective Layer>

The protective layer contains at least a binder resin, and may contain a crosslinking agent and filler, and other component(s) if necessary.

-Binder Resin-

The binder resin in the protective layer contains diacetone-modified polyvinyl alcohol. The content of the diacetone-modified polyvinyl alcohol in the binder resin is preferably 50% by mass or greater, more preferably 70% by mass or greater, and the most preferably 80% to 100% by mass.

If the content is less than 50% by mass, coating undulation may occur because effects of by other resin(s).

The degree of polymerization of the binder resin in the protective layer is 1,000 to 1,800, and preferably 1,500 to 1,700. When the degree of polymerization exceeds 1,800, the sheer speed at the inflection point of the viscosity change in a high shear speed region becomes less than $1.0\times10^6$ $sec^{-1}$ and the coating undulation may occur, and if it is less than 1,000, even though sheer speed at the inflection point in the high shear speed region becomes $1.0\times10^6$ $sec^{-1}$ or greater, the water resistance of the protective layer may be decreased.

Here, the degree of polymerization of the binder resin in the protective layer can be measured, for example, using a test method specified in JIS K6726.

Further, the degree of saponification of the binder resin in the protective layer is 90% or greater but less than 98%, and preferably 95% to 97%. If the degree of saponification is 98% or greater, the sheer speed at the inflection point of the viscosity change in the high shear speed region becomes less than $1.0\times10^6$ $sec^{-1}$ and the coating undulation occurs. In the meantime, if the degree of saponification is less than 90%, the quality of the binder resin itself becomes decreases; therefore, it results in troubles such as decrease in the solubility of the binder resin or disability to obtain sufficient functions as a protective layer.

Here, the degree of saponification of the binder resin in the protective layer can be measured, for example, using a test method specified in JIS K6726.

Furthermore, the degree of polymerization and the degree of saponification of the binder resin in the protective layer can be measured using the measurement method mentioned above. However, even when the binder resin is crosslinked using a crosslinking agent, it is possible to measure the degree of polymerization and the degree of saponification of the binder resin before crosslinking, by decomposing a crosslinking substance using a specific method.

The diacetone-modified polyvinyl alcohol can be produced using, for example, a well-known method of saponifying a polymer obtained by copolymerizing a diacetone group-containing vinyl monomer and fatty acid vinyl ester. Examples of the diacetone group-containing vinyl monomer include, for example, diacetone acrylamide and metadiacetone acrylamide. Examples of the fatty acid vinyl ester include, for example, vinyl formate, vinyl acetate and vinyl propionate, and among them, vinyl acetate is particularly preferable.

Further, the diacetone-modified polyvinyl alcohol may one obtained by copolymerization of a copolymerizable vinyl monomer. Examples of the copolymerizable vinyl monomer include, for example, acrylic ester, butadiene, ethylene, propylene, acrylic acid, methaacrylic acid, maleic acid, maleic anhydride and itaconic acid.

The degree of modification, which indicates the content of a reactive carbonyl group in the diacetone-modified polyvinyl alcohol, also participates in the occurrence of coating undulation as do the degree of polymerization and the degree of saponification. When the degree of modification is increased, the degree of undulation is reduced. The degree of modification in the diacetone-modified polyvinyl alcohol is preferably 0.5 mol % to 20 mol %, and more preferably 2 mol % to 10 mol % in view of coating uniformity and water resistance. If the degree of modification is less than 0.5 mol %, the water resistance may become practically insufficient, and if it exceeds 20 mol %, the water resistance improving effect cannot be obtained, resulting in economical disadvantages.

As the method for applying a coating solution for protective layer onto the heat-sensitive color developing layer, a coating method capable of application of high shear speed upon coating, e.g., a rod blade method or a roller blade method, is preferable.

In the rod blade method or roller blade method, when the coating solution for protective layer, which has been applied onto the heat-sensitive color developing layer, is scraped by a bar (blade), the coating solution passes through a narrow gap of several μm to tens of μm, formed between the heat-sensitive color developing layer and the bar. At this time, the coating solution receives a high shear speed, and undulation may occur over the coated surface.

The shear speed that is received by coating solution upon its scraping the bar is proportional to the application speed and inversely proportional to the gap between the heat-sensitive color developing layer and the bar. When the binder resin receives a certain level of high shear speed, it instantaneously shows physical properties of solid. This physical properties apply to the binder resin in the coating solution for protective layer as well, and the physical properties of the binder resin for solidification leads to coating undulation. Further, when applying the coating solution for protective layer at high speed for improved productivity, the coating solution receives a higher shear speed. For this reason, the frequency at which coating undulation occurs further increases and it becomes difficult to conduct high-speed coating.

Because no coating undulation occurs when the binder resin in the coating solution for protective layer is allowed to remain liquid even after receipt of high shear speed, it is effective to evaluate the degree of the liquid state of binder resin in the high-shear speed region. As this evaluation method, a viscosity measurement in the high shear speed region is available. In this method, when the viscosity of the binder resin is measured in the high shear speed region, if the shear speed is increased, the viscosity of the binder resin gradually decreases. However, the viscosity starts to increase after reaching a certain shear speed, which is unique to each binder resin. At this time, the point where the viscosity becomes the lowest is referred to as an inflection point, and the degree of possible coating undulation that the binder resin creates can be evaluated on the basis of the shear speed at this inflection point. It is believed that the physical property of the binder resin changes from liquid state to solid state at this inflection point as a boundary. Then, the higher the shear speed where the inflection point appears becomes, the less the likelihood of the occurrence of undulation even in the environment to receive high shear speeds. Thus, application of binder resin is made possible.

Here, for the measurement of the viscosity change the binder resin in the high-shear speed region, the viscosity change of a solution (for example, water) containing 13% by mass of the solid content of binder resin in the high shear speed was measured under the environment of 30° C. using "HVA-6" manufactured by Nihon SiberHegner K.K. as a measuring instrument. Measurements for the binder resin 1 (diacetone-modified polyvinyl alcohol; degree of polymerization=2,000, degree of saponification=99.0%) and the binder resin 2 (diacetone-modified polyvinyl alcohol; degree of polymerization=1,700, degree of saponification=96.5%) are shown in FIG. 1.

From the results shown in FIG. 1, it is confirmed that the binder resin 2 that satisfies requirements for the degree of polymerization and the degree of saponification of the binder resin in a protective layer of the present invention shows $1.0\times10^6$ $sec^{-1}$ or greater for the sheer speed at the inflection point of the viscosity change in a high shear speed region; in the meantime, the binder resin 1 that fails to satisfy requirements for the degree of polymerization and the degree of saponification of the binder resin of a protective layer of the present invention shows less than $1.0\times10^6$ $sec^{-1}$ for the sheer speed at the inflection point of the viscosity change at the high shear speed region.

Therefore, satisfying the requirement that the sheer speed at the inflection point of the viscosity change of a solution containing 13% by mass of the solid content of binder resin in a protective layer in the high shear speed region at 30° C. is $1.0\times10^6$ $sec^{-1}$ or greater enables excellent coating without causing coating undulation even under a condition to receive a high shear speed.

In the case of combining another diacetone-modified polyvinyl alcohol having a different degree of polymerization and degree of saponification as a binder resin in the protective layer, it is preferable that the degree of polymerization of the mixed resin be 1,000 to 1,800, and that its degree of saponification be 90% or greater and less than 98% or the sheer speed at the inflection point of the viscosity change of a mixed resin solution in the high shear speed region be $1.0\times10^6$ $sec^{-1}$ or greater.

Further, if the mixed resin satisfies 1,000 to 1,800 of the degree of polymerization and 90% or greater and less than 98% of degree of saponification, or satisfies $1.0\times10^6$ $sec^{-1}$ or greater of the sheer speed at the inflection point of the viscosity change of the mixed resin solution in the high-shear speed region, it is also possible to combine, if necessary, other binder resin than diacetone-modified polyvinyl alcohol, to a level that does not degrade the protective layer. Examples of other binder resins include non-modified polyvinyl alcohol, carboxy modified polyvinyl alcohol, acetoacetyl modified polyvinyl alcohol, sulfonyl modified polyvinyl alcohol, silanol modified polyvinyl alcohol and epoxy modified polyvinyl alcohol.

Furthermore, even if the binder resin in the protective resin is used not only for coating solutions for protective layer, but also for coating solutions for heat-sensitive color developing layer and coating solutions for back layer, it is possible to provide excellent coat surface free from coating undulation; therefore, the binder resin can be suitably used for such coating solutions.

-Crosslinking Agent-

As the crosslinking agent, a hydrazine crosslinking agent is suitably used. As the hydrazine crosslinking agent, there are no restrictions as long as it contains a hydrazide group, and can be appropriately selected in accordance with the purpose. For example, examples thereof include carbohydrazide, dihydrazide oxalate, hydrazide formate, hydrazide acetate, dihydrazide malonate, dihydrazide succinate, dihydrazide adipate, hydrazide azelate, dihydrazide sebacate, dihydrazide dodecanedioate, dihydrazide maleate, hydrazide fumarate, dihydrazide itaconate, hydrazide benzoate, dihydrazide glutarate, hydrazide diglycolate, dihydrazide tartrate, dihydrazide malate, hydrazide isophthalate, dihydrazide terephthalate, dihydrazide 2,7-naphthoate and hydrazide polyacrylate. These compounds may be used singly or in combination. Among them, dihydrazide adipate is particularly preferable in light of water resistance and safety.

The added amount of the crosslinking agent in the coating solution for protective layer varies depending upon the degree of modification and the type of functional group in the crosslinking agent; it is preferably added in an amount of 0.1 parts by mass to 20 parts by mass, more preferably 1 part by mass to 10 parts by mass per 100 parts by mass of the binder resin.

-Filler-

As the filler, inorganic or organic fine particles are used. Examples of inorganic fine particles include, for example, silicate, such as silicon dioxide, calcium silicate, magnesium silicate, aluminum silicate, zinc silicate or amorphous silica; zinc oxide, aluminum oxide, titanium dioxide, aluminum hydroxide, barium sulphate, talc, clay, magnesium oxide, magnesium hydroxide, calcium carbonate and magnesium carbonate. Examples of organic fine particles include, for example, nylon resin filler, styrene-methacrylic acid copolymer filler, polystyrene resin filler, urea/formalin resin filler and raw starch particles.

The added amount of the filler into the coating solution for protective layer varies depending upon the type of filler; it is preferably added in an amount of 50 parts by mass to 500 parts by mass per 100 parts by mass of the binder resin.

The protective layer is preferably formed with a method for forming a protective layer, which includes the step of applying a coating solution for protective layer onto the heat-sensitive color developing layer. Details thereof will be described in the production method for a heat-sensitive recording material described below.

The deposited amount of the protective layer after dried is preferably 0.5 $g/m^2$ to 5.0 $g/m^2$, and more preferably, 1.5 $g/m^2$ to 3.5 $g/m^2$.

<Heat-Sensitive Color Developing Layer>

The heat-sensitive color developing layer contains at least a leuco dye, a developer and a binder resin, and it further contains other component(s) if necessary.

-Leuco Dye-

The leuco dye is not particularly restricted, and it can be appropriately selected from those used for heat-sensitive recording materials in accordance with the purpose. For example, preferred examples include dye-based leuco compounds of triphenylmethane-type, fluoran-type, phenothiazine-type, auramine-type, spiropyran-type and indolinophthalide-type.

Specific examples of the leuco dye include 2-anilino-3-methyl-6-dibutylaminofluoran, 3,3-bis(p-dimethylaminophenyl)-phthalide, 3,3-bis(p-dimethylaminophenyl)-6-dimethylaminophthalide (secondary name: crystal violet lactone), 3,3-bis(p-dimethylaminophenyl)-6-diethylaminophthalide, 3,3-bis(p-dimethylaminophenyl)-6-chlorphthalide 3,3-bis(p-dibutylaminophenyl) phthalide, 3-cyclohexylamino-6-chlorfluoran, 3-dimethylamino-5,7-dimethylfluoran, 3-dimethylamino-7-chlorofluoran, 3-dimethylamino-7-methylfluoran, 3-diethylamino-7,8-benzfluoran, 3-diethylamino-6-methyl-7-chlorfluoran, 3-(N-p-tolyl-N-ethylamino)-6-methyl-7-anilinofluoran, 2-{N-(3'-trifluoromethylphenyl)amino}-6-diethylaminofluoran, 2-{3,6-bis(diethylamino)-9-(o-chloranilino) xanthosine lactam benzoate, 3-diethylamino-6-methyl-7-(m-trichloromethylanilino)fluoran, 3-diethylamino-7-(o-chloranilino) fluoran, 3-pyrrolidino-6-methyl-7-anilinofluoran, 3-di-n-butylamino-7-o-chloranilino) fluoran, 3-N-methyl-N,n-amylamino-6-methyl-7-anilinofluoran, 3-N-methyl-N-cyclohexylamino-6-methyl-7-anilinofluoran, 3-diethylamino-6-methyl-7-anilinofluoran, 3-(N,N-diethylamino)-5-methyl-7-(N,N-dibenzyl amino) fluoran, benzoyl leuco methylene blue, 6'-chloro-8'-methoxy-benzoindolino-spiropyran, 6'-bromo-3'-methoxy-benzoindolino-spiropyran, 3-(2'-hydroxy-4'-dimethylaminophenyl)-3-(2'-methoxy-5'chlorphenyl) phthalide, 3-(2'-hydroxy-4'-dimethylaminophenyl)-3-(2'-methoxy-5'-nitrophenyl) phthalide, 3-(2'-hydroxy-4'-diethylaminophenyl)-3-(2'-methoxy-5'-methylphenyl) phthalide, 3-(2'-methoxy-4'-dimethylaminophenyl)-3-(2'-hydroxy-4'-chlor-5'-methylphenyl) phthalide, 3-(N-ethyl-N-tetrahydrofurfuryl)amino-6-methyl-7-anilinofluoran, 3-N-ethyl-N-(2-ethoxypropyl)amino-6-methyl-7-anilinofluoran, 3-N-methyl-N-isobutyl-6-methyl-7-anilinofluoran, 3-morpholino-7-(N-propyl-trifluoromethylanilino) fluoran, 3-pyrrolidino-7-trifluoromethylanilinofluoran, 3-diethylamino-5-chloro-7-(N-benzyl-trifluoromethylanilino) fluoran, 3-pyrrolidino-7-(di-p-chlorphenyl)methylaminofluoran, 3-diethylamino-5-chlor-7-(α-phenylethylamino) fluoran, 3-(N-ethyl-p-toluidino)-7-(α-phenylethylamino) fluoran, 3-diethylamino-7-(o-methoxycarbonylphenylamino) fluoran, 3-diethylamino-5-methyl-7-(α-phenylethylamino) fluoran, 3-diethylamino-7-piperidinofluoran, 2-chloro-3-(N-methyltoluidino)-7-(p-n-butylanilino) fluoran, 3-di-n-butylamino-6-methyl-7-anilinofluoran, 3,6-bis(dimethylamino) fluorenespiro(9,3')-6'-dimethyaminophthalide, 3-(N-benzyl-N-cyclohexylamino)-5,6-benzo-7-α-naphthylamino-4'-promofluoran, 3-diethylamino-6-chlor-7-anilinofluoran, 3-diethylamino-6-methyl-7-mesitydino-4',5'-benzofluoran, 3-N-methyl-N-isopropyl-6-methyl-7-anilinofluoran, 3-N-ethyl-N-isoamyl-6-methyl-7-anilinofluoran, 3-diethylamino-6-methyl-7-(2'4'-dimethylanilino) fluoran, 3-morpholino-7-(N-propyl-trifluoromethylanilino) fluoran, 3-pyrrolidino-7-trifluoromethylanilinofluoran, 3-diethylamino-5-chloro-7-(N-benzyl-trifluoromethylanilino) fluoran, 3-pyrrolidino-7-(di-p-chlorphenyl)methylaminofluoran, 3-diethylamino-5-chlor-(α-phenylethylamino) fluoran, 3-(N-ethyl-p-toluidino)-7-α-phenylethylamino) fluoran, 3-diethylamino-7-(o-methoxycarbonylphenylamino) fluoran, 3-diethylamino-5-methyl-7-(α-phenylethylamino) fluoran, 3-diethylamino-7-pyperidinofluoran, 2-chloro-3-(N-methyltoluidino)-7-(p-N-butylanilino) fluoran, 3,6-bis(dimethylamino) fluorenespiro(9,3')-6'-dimethylaminophthalide, 3-(N-benzyl-N-cyclohexylamino)-5,6-benzo-7-α-naphthylamino-4'-bromofluoran, 3-diethylamino-6-chlor-7-anilinofluoran, 3-N-ethyl-N-(-2-ethoxypropyl)amino-6-methyl-7-anilinofluoran, 3-N-ethyl-N-tetrahydrofurfurylamino-6-methyl-7-anilinofluoran, 3-diethylamino-6-methyl-7-mesitydino-4',5'-benzofluran, 3-p-dimethylaminophenyl)-3-{1,1-bis(p-dimethylaminophenyl)ethylene-2-yl}phthalide, 3-(p-dimethylaminophenyl)-3-{1,1-bis(p-dimethylaminophenyl)ethylene-2-yl}-6-dimethylaminophthalide, 3-(p-dimethylaminophenyl)-3-(1-p-dimethylaminophenyl-1-phenylethylene-2-yl) phthalide, 3-(p-dimethylaminophenyl)-3-(1-p-dimethylaminophenyl-1-p-chlorophenylethylene-2-yl)-6-dimethylaminophthalide, 3-(4'-dimethylamino-2'-methoxy)-3-(1"-p-dimethylaminophenyl-1"-p-chlorophenyl-1",3"-butadiene-4"-yl)benzophthalide, 3-(4'-dimethylamino-2'-benzyloxy)-3-(1"-p-dimethylaminophenyl-1"-phenyl-1",3"-butadiene-4"-yl) benzophthalide, 3-dimethylamino-6-dimethylamino-fluorene-9-spiro-3'-(6'-dimethylamino) phthalide, 3,3-bis(2-(p-dimethylaminophenyl)-2-p-methoxyphenyl)ethenyl)-4,5,6,7-tetrachlorophthalide, 3-bis{1,1-bis(4-pyrrolidinophenyl) ethylene-2-yl}-5,6,dichloro-4,7-dipromophthalide, bis(p-dimethylaminostyryl)-1-naphthalenesulfonylmethane and bis(p-dimethylaminostyryl)-1-p-tolylsulfonylmethane. These compounds may be used singly or in combination.

-Developer-

Examples of the developer include various electron acceptable compounds that develop the color of the leuco dye, and oxidants. This developer is not particularly restricted, and it can be appropriately selected from those well-known in accordance with the purpose. Specific examples include 4,4'-isopropylidenebisphenol, 4,4'-isopropylidenebis(o-methylphenyl), 4,4'-sec-butylidenebisphenyl, 4,4'-isoisopropylidenebis(2-tertiarybutylphenyl), p-nitrobenzoic acid zinc, 1,3,5-tris(4-tertiarybutyl-3-hydroxy-2,6-dimethylbenzyl) isocyanuric acid, 2,2-(3,4'-dihydroxydiphenyl)propane, bis(4-hydroxy-3-methylphenyl)sulfide, 4-{β-(p-methoxyphenoxy)ethoxy}salicylic acid, 1,7-bis(4-hydroxyphenylthio)-3,5-dioxaheptane, 1,5-bis(4-hydroxyphenythio)-5-oxapentane, monobenzylester phthalate monocalcium salt, 4,4'-cyclohexylidynediphenol, 4,4'-isopropylidenebis(2-chlorophenol), 2,2'-methylenebis(4-methyl-6-tertiarybutylphenol), 4,4'-butylidenebis(6-tertiarybutyl-2-methyl)phenol, 1,1,3-tris(2-methyl-4-hydroxy-5-tertiarybutylphenyl) butane, 1,1,3-tris(2-methyl-4-hydroxy-5-cyclohexylphenyl) butane, 4,4'-thiobis(6-tertiarybutyl-2-methyl)phenol, 4,4'-diphenolsulfone, 4-isopropoxy-4'-hydroxydiphenylsulfone (4-hydroxy-4'-isopropoxydiphenylsulfone), 4-benzyloxy-4'-hydroxydiphenylsulfone, 4,4'-diphenolsulfoxide, p-isopropylhydroxybenzoate, p-benzylhydroxybenzoate, benzylprotocatechuic acid, stearyl gallate, lauryl gallate, octyl gallate, 1,3-bis(4-hydroxyphenylthio)-propane, N,N'-diphenylthiourea, N,N'-di(m-chlorophenyl)thiourea, salicylanilide, bis-(4-hydroxyphenyl)acetic acid methyl ester, bis-(4-hydroxyphenyl)acetic acid benzyl ester, 1,3-bis(4-hydroxycumyl)benzene, 1,4-bis(4-hydroxycumyl)benzene, 2,4'-diphenolsulfone, 2,2'-diallyl-4,4'-diphenolsulfone, 3,4-dihydroxyphenyl-4'-methyldiphenylsulfone, 1-acetyloxy-2-zinc naphthoate, 2-acetyloxy-1-zinc naphthoate, 2-acetyloxy-3-zinc naphthoate, α,α-bis(4-hydroxyphenyl)-α-methyltoluene, antipyrine complex of zinc thiocyanate, tetrabromobisphenol A, tetrabromobisphenol S, 4,4'-thiobis(2-methylphenol) and 4,4'-thiobis(2-chlorophenol). These compounds may be used singly or in combination.

The developer is preferably added in an amount of 1 part by mass to 20 parts by mass, more preferably 2 parts by mass to 10 parts by mass per 1 part by mass of the leuco dye -Binder Resin- As the binder resin, the diacetone-modified polyvinyl alcohol, which is the same as the one for the protective layer, can be used. Further, other than the diacetone-modified polyvinyl alcohol, which is the same as the one for the protective layer, another binder resin can be appropriately selected, and still other binder resin can be further combined. Examples of such additional binder resins include polyvinyl alcohol resin, starch or derivatives thereof; cellulose derivatives, such as hydroxymethyl cellulose, hydroxyethyl cellulose, carboxymethyl cellulose, methyl cellulose or ethyl cellulose; water-soluble polymers, such as sodium polyacrylate, polyvinylpyrrolidone, acrylic amide-acrylic ester copolymer, acrylic amide-acrylic ester-methacrylic acid ternary copolymer, styrene-maleic acid anhydride copolymer alkaline salt, isobutylene-maleic anhydride copolymer alkaline salt, polyacrylamide, sodium alginate, gelatin or casein; emulsions, such as polyvinyl acetate, polyurethane, polyacrylic acid, polyacrylate, chloroethylene-vinyl acetate copolymer, polymethylmethacrylate or ethylene-vinyl acetate copolymer; and latex, such as styrene-butadiene copolymer or styrene-butadiene-acrylic copolymer.

Further, various thermofusible materials can be added to the heat-sensitive color developing layer as a sensitivity improver. Furthermore, if heat resistance is required for use in, for example, packages for prepared meals, it is preferable not to add such thermofusible material as much as possible or to select and use a compound whose melting point is 100° C. or higher. The thermofusible material is not particularly restricted, and it can be appropriately selected in accordance with the purpose; examples thereof includes fatty acids, such as stearic acid or behenic acid; fatty amides, such as amide stearate or amide palmitate; fatty acid metal salts, such as zinc stearate, aluminum stearate, calcium stearate, zinc palmitate or zinc behenate; p-benzylbiphenyl, terphenyl, triphenylmethane, p-benzyloxy benzyl benzoate, β-benzyloxynaphthalene, β-phenylnaphthoate, 1-hydroxy-2-phenylnaphthoate, 1-hydroxy-2-methylnaphthoate, diphenylcarbonate, greacol/griacol carbonate, dibenzyl terephthalate, dimethyl terephthalate, 1,4-dimethoxynaphthalene, 1,4-diethoxynaphthalene, 1,4-dibenziloxynaphthalene, 1,2-diphenoxyethane, 1,2-bis(3-methylphenoxy)ethane, 1,2-bis(4-methylphenoxy)ethane, 1,4-diphenoxy-2-butene, 1,2-bis(4-methoxyphenylthio)ethane, dibenzoylmethane, 1,4-diphenylthiobutane, 1,4-diphenylthio-2-butene, 1,3-bis(2-vinyloxyethoxy)benzene, 1,4-bis(2-vinyloxyethoxy)benzene, p-(2-vinyloxyethoxy)biphenyl, p-aryloxybiphenyl, p-propargyloxybiphenyl, dibenzoyloxymethane, dibenzoyloxypropane, dibenzylsulfide, 1,1-diphenylethanol, 1,1-diphenylpropanol, p-benzyloxybenzylalcohol, 1,3-phenoxy-2-propanol, N-octadecylcarbamoyl-p-methoxycarbonylbenzene, N-octadecylcarbamoylbenzene, 1,2-bis(4-methoxyphenoxy)propane, 1,5-bis(4-methoxyphenoxy)-3-oxapentane, dibenzyl oxalate, bis(4-methylbenzyl)oxalate and bis(4-chlorobenzyl)oxalate.

Further, various hindered phenol compounds or hindered amine compounds, which are electron-acceptable but have comparatively low color-chromogenic capability, may be added to the heat-sensitive color developing layer as an auxiliary additive if necessary. Specific examples include 2,2'-methylenebis(4-ethyl-6-tertiarybutylphenol), 4,4'-butylidynebis(6-tertiarybutyl-2-methylphenol), 1,1,3-tris(2-methyl-4-hydroxy-5-tertiarybutylphenyl)butane, 1,1,3-tris(2-methyl-4-hydroxy-5-cyclohexylphenyl)butane, 4,4'-thiobis(6-tertiarybutyl-2-methylphenol), tetrabromobisphenol A, tetrabromobisphenol S, 4,4'-thiobis(2-methylphenol), 4,4'-thiobis(2-chlorophenol), tetrakis(1,2,2,6,6-pentamethyl-4-piperidyl)-1,2,3,4-butanetetracarboxylate and tetrakis(1,2,2,6,6-tetramethyl-4-piperidyl)-1,2,3,4-butanetetracarboxylate.

Various auxiliary additives, such as a surfactant, a lubricant, and/or filler, can be further added to the heat-sensitive color developing layer if necessary. Examples of the lubricant includes, for example, higher fatty acids or metal salts thereof, higher fatty acid amides, higher fatty acid esters, animal waxes, vegetable waxes, mineral waxes and petroleum waxes.

Examples of the filler include, for example, inorganic fine particles, such as calcium carbonate, silica, zinc oxide, titanium oxide, aluminum hydroxide, zinc hydroxide, barium sulfate, clay, kaolin, talc, surface-treated calcium or surface-treated silica; and organic fine particles, such as urea-formalin resin, styrene-methacrylic acid copolymer, polystyrene resin or vinylidene chloride resin.

The heat-sensitive color developing layer can be formed using any generally-known method. For example, after a leuco dye and a developer are ground and dispersed together with a binder resin and other components by use of a disperser such as a ball mill, ATTRITOR or sand mill until the dispersed particles has a diameter of from 0.1 μm to 3 μm, the resultant dispersion is mixed with filler and a thermofusible material dispersion liquid if necessary to prepare a coating solution for heat-sensitive color developing layer. Thereafter, the coating solution is applied onto a substrate and dried, whereby, a heat-sensitive color developing layer is formed.

The deposited amount of the heat-sensitive color developing layer after dried varies depending upon the composition of the heat-sensitive color developing layer and the application of the thermosensitive recording material, and therefore, it cannot be flatly determined; however, 1 $g/m^2$ to 20 $g/m^2$ are preferable, and 3 $g/m^2$ to 10 $g/m^2$ are more preferable.

<Substrate>

The substrate is not particularly restricted in consituent material, shape, structure and size. Examples of shape includes, for example, a sheet, a roll and a plate; the structure can be a single-layer structure or a laminated structure; and the size can be appropriately selected according to the size of the thermosensitive recording material. Examples of the constituent material includes plastic films, synthetic paper films, high-quality paper, recycled pulp, recycle paper, one-side enameled paper, greaseproof paper, coated paper, art paper, cast-coated paper, fine coating paper and resin laminate paper.

The thickness of the substrate is not particularly restricted, and it can be appropriately selected in accordance with the purpose, and thickness of 30 μm to 2,000 μm is preferable, and thickness of 50 μm to 1,000 μm is more preferable.

As the lamination of the thermosensitive recording material of the present invention, an aspect having a substrate, a heat-sensitive color developing layer arranged on the substrate, and a protective layer arranged on the heat-sensitive color developing layer is preferable, and it is more preferable to provide a back layer on the substrate surface (rear surface) where no heat-sensitive color developing layer is arranged.

In addition, an under-layer may be formed between the substrate and the heat-sensitive color developing layer. Furthermore, each of these layers may be a single layer or multilayer.

<Back Layer>

The back layer contains at least a binding layer, and it further contains other component(s) if necessary.

As the binder resin, the diacetone-modified polyvinyl alcohol, which is the same as the one for the protective layer, can be used. Other than the diacetone-modified polyvinyl alcohol, which is the same as the one for the protective layer, other binder resin(s) can be combined, as well. Examples of the other binder resin include, for example, cellulose derivatives, such as polyvinyl alcohol resin, starch or their derivative, methoxy cellulose, hydroxyethyl cellulose, carboxymethyl cellulose, methyl cellulose or ethyl cellulose;

sodium polyacrylate, polyvinylpyrrolidone, acrylic amide-acrylic ester copolymer, acrylic amide-acrylic ester-methacrylic acid ternary copolymer, styrene-maleic anhydride copolymer alkali salt, isobutylene-maleic anhydride copolymer alkali salt, polyacrylamide, sodium alginate, gelatin and casein. These compounds may be used singly or in combination.

It is preferable that the back layer contain a water resistance additive if necessary. The water resistance additive includes, for example, formalin, glyoxal, chrome alum, melamine resin, melamine-formalin resin, polyamide, polyamide-epichlorohydrin resin and hydrazine hydrazide compound.

In addition, filler, such as inorganic filler or organic filler, a surfactant, a thermofusible material, a lubricant and other auxiliary agent can be used in the back layer if necessary.

The formation method for the back layer is not particularly restricted, and it can be appropriately selected in accordance with the purpose, and a method where a back layer is formed by applying a coating solution for back layer onto a substrate is preferable. The coating method is not particularly restricted, and it can be appropriately selected in accordance with the purpose, and examples include, for example, blade coating, gravure coating, gravure offset coating, bar coating, roll coating, knife coating, air-knife coating, comma coating, U-comma coating, AKKU coating, smoothing coating, micro-gravure coating, reverse roll coating, 4- to 5-roll coating, dip coating, curtain coating, slide coating, and die coating.

After coating, the resultant layer may be dried if necessary, and the drying temperature is not particularly restricted, and it can be appropriately selected in accordance with the purpose, and the drying temperature is preferably 30° C. to 250° C.

The deposited amount of the back layer after dried is preferably 0.1 $g/m^2$ to 4.0 $g/m^2$, more preferably 0.2 $g/m^2$ to 3.0 $g/m^2$.

<Thermosensitive Recording Label>

In the first embodiment, a thermosensitive recording label as the thermosensitive recording material has an binding agent layer and separation paper attached onto the surface of the binding agent layer on a substrate surface (rear surface) where no heat-sensitive color developing layer is arranged, and it has other component(s) if necessary. Furthermore, the back layer surface is also provided on the rear surface.

The material of the binding agent layer is not particularly restricted, and it can be appropriately selected in accordance with the purpose, and examples include, for example, urea resins, melamine resins, phenol resins, epoxy resins, vinyl acetate resins, vinyl acetate-acrylic copolymers, ethylene-vinyl acetate copolymers, acrylic resins, polyvinyl ether resins, vinyl chloride-vinyl acetate resins, polystyrene resins, polyester resins, polyurethane resins, polyamide resins, chlorinated polyolefin resins, polyvinyl butyral resins, acrylate copolymers, methacrylate copolymers, natural rubbers, cyanoacrylate resins and silicone resins. These compounds may be used singly or in combination.

In the second embodiment, the thermosensitive recording label contains a thermosensitive binding agent layer that exhibits adhesiveness upon heating, on a substrate surface (rear surface) where no heat-sensitive color developing layer is arranged, and it further contains other component(s) if necessary. Furthermore, the back layer surface is also provided on the rear surface.

The thermosensitive binding agent layer contains a thermoplastic resin and a thermofusible material, and it further contains a tackfier if necessary.

The thermoplastic resin imparts an adhesive force and adhesive strength. Since the thermofusible material is a solid at room temperature, even though it does not provide plasticity to a resin, this thermofusible material is melted by heating and swells and softens the resin, and then exhibits adhesiveness. Further, the tackfier has a function to improve adhesiveness.

This thermosensitive recording label is made applicable to POS labels and labels for distribution of goods, expanding its application, and those with no separation paper are more environmentally-friendly.

<Thermosensitive Magnetic Recording Paper>

Thermosensitive magnetic recording paper as the thermosensitive recording material has a magnetic recording layer on a substrate surface where no thermosensitive color developing layer is arranged, and it further has other component(s) if necessary. Furthermore, the back layer surface is also provided on the rear surface.

The magnetic recording layer can be formed by coating of substrate with iron oxide or barium ferrite, together with vinyl chloride resin, urethane resin or nylon resin, or can be formed by means of deposition, sputtering or the like of them.

It is preferable that the magnetic recording layer be arranged on a substrate surface, which is opposite from the surface where the heat-sensitive color developing layer is arranged; however, it may be arranged between the substrate and the heat-sensitive color developing layer or on a portion of the heat-sensitive color developing layer.

This thermosensitive magnetic recording paper becomes applicable to tickets for railroads, bullet trains and subways, so its application will be expanded.

<Production Method for Thermosensitive Recording Material>

The production method for a thermosensitive recording material of the present invention includes a protective layer formation step, and it further includes other step(s) if necessary.

The protective layer formation step is a step where a protective layer is formed by applying a coating solution for protective layer containing at least a binder resin whose degree of polymerization is 1,000 to 1,800 and degree of saponification is 90% or greater and less than 98% using one of the rod blade method and roller blade method.

As the binder resin, it is preferable to contain a diacetone-modified polyvinyl alcohol resin.

As a method for applying a coating solution for protective layer, a coating method that can apply high shear speeds at the time of coating, such as the rod blade method or roller blade method, is preferably used.

The rod blade method is a coating method where the coating solution for protective layer transferred onto the heat-sensitive color developing layer on the substrate is scraped by a blade and measured using any method for smoothing the coated surface. For the blade (bar), a round, chrome-plated metaling bar of 10 mm to 12 mm in diameter is used. This metalling bar is fitted to a plastic head having rubber plasticity, and is used by turning around in the traveling direction of the substrate.

The roller blade method is an application method where the coating solution for protective layer is transferred onto the heat-sensitive color developing layer on the substrate using any method, and any excess coating solution is scraped by a rod of 6 mm to 10 mm external diameter, which is tightly wound with piano wire or stainless wire with 0.1 mm to 0.8 mm thickness. Furthermore, a flat bar where no wire is wound to a rod can also be used.

The rod blade method and the roller blade method are the same in the coating principles where the coating solution for protective layer applied onto the heat-sensitive color developing layer on the substrate is scraped by a means of a bar-shaped article, even though the shape of the blade (bar) is different.

Furthermore, the rod blade method and the roller blade method are described in detail, for example, in "All about coating" published by Converting Technical Institute.

The application speed of the coating solution for protective layer is preferably 300 m/min or faster, more preferably 500 m/min are faster, and further preferably 700 m/min to 1,000 m/min. High-speed coating results in the productivity improvement, and causes no coating undulation.

After coating, the layer may be dried if necessary. The drying temperature is not particularly restricted, and it can be appropriately selected in accordance with the purpose; the drying temperature is preferably 100° C. to 250° C.

The other steps include, for example, a heat-sensitive color developing layer formation step, a back layer formation step and an under-layer formation step.

The shape of the thermosensitive recording material of the present invention is not particularly restricted and it can be appropriately selected in accordance with the purpose, and examples of includes label, sheet and roll shapes.

Further, the recording method using the thermosensitive recording material of the present invention is not particularly restricted and it can be appropriately selected in accordance with the purpose, and examples include heating by means of thermal stylus, thermal head, and laser.

The thermosensitive recording material of the present invention does not generate printing unevenness, excels in the barrier properties, such as oil resistance and plasticizer resistance, and offers excellent printability, so it is preferably used in various fields including POS field, such as use in perishable foods, for packed lunches or prepared meals; copying field, such as use in books or documents; communication field, such as use in facsimiles; ticketing field, such as use in ticket vending machines, receipts or vouchers; and tags for baggage in the airline industry.

EXAMPLES

Examples of the present invention will be described hereafter which however shall not be construed as limiting the scope of the present invention. Note also that "part(s)" means "part(s) by mass" unless otherwise indicated.

In Examples and Comparative Examples mentioned below, "a degree of polymerization of a binder resin", "a degree of saponification of a binder resin" and "an inflection point of viscosity change of a binder resin solution in a high shear speed region" were measured as follows:

<Measurement of Degree of Polymerization of Binder Resin>

The degree of polymerization of a binder resin was measured using a test method specified in JIS K6726.

<Measurement of Degree of Saponification of Binder Resin>

The degree of saponification of a binder resin was measured using a test method specified in JIS K6726.

<Inflection Point of Viscosity Change of Binder Resin Solution in High Shear Speed Region>

A viscosity change of a solution containing 13% by mass of the solid content of binder resin (measurement target) in the high shear speed region was measured under the environment at 30° C. using "HVA-6" manufactured by Nihon SiberHegner K.K. as a measuring instrument, and the inflection point of the viscosity change was obtained.

Example 1

-Preparation of Heat-Sensitive Recording Material- (1) Preparation of Dye Dispersion Liquid (Liquid A)

The following ingredients were dispersed by a sand mill until the resultant mixture has an average particle size of 0.5 μm, to thereby prepare a dye dispersion liquid (Liquid A).

- 2-anilino-3-methyl-6-dibutylaminofluoran . . . 20 parts
- 10% by mass aqueous solution of polyvinyl alcohol . . . 20 parts
- Water . . . 60 parts (2) Preparation of Liquid B The following ingredients were dispersed by a ball mill until the resultant mixture has an average particle size of 1.5 μm, to thereby prepare Liquid B.

- Aluminum hydroxide filler . . . 20 parts
- 4-hydroxy-4'-isopropoxydiphenylsulfone . . . 20 parts
- 10% by mass aqueous solution of polyvinyl alcohol . . . 20 parts
- Water . . . 40 parts (3) Preparation of Liquid C The following ingredients were dispersed by a ball mill until the resultant mixture has an average particle size of 1.5 μm, to thereby prepare Liquid C.

- Aluminum hydroxide filler . . . 100 parts
- Aqueous solution of polyvinyl alcohol (solid content=10% by mass) . . . 20 parts
- Water . . . 40 parts (4) Preparation of Coating Solution for Heat-Sensitive Color Developing Layer The following ingredients were mixed to prepare a coating solution for heat-sensitive color developing layer.

- Liquid A . . . 20 parts
- Liquid B . . . 60 parts
- Aqueous solution of diacetone-modified polyvinyl alcohol resin (degree of polymerization=2,000, degree of saponification=99.0%, degree of modification=4.0 mol %, solid content=10% by mass) . . . 30 parts
- Aqueous solution of dioctyl sulfosuccinate (solid content=5% by mass) . . . 1 part (5) Preparation of Coating Solution for Protective Layer The following ingredients were mixed to prepare a coating solution for protective layer.

- Liquid C . . . 60 parts
- Aqueous solution of diacetone-modified polyvinyl alcohol resin (degree of polymerization=1,800, degree of saponification=97.5%, degree of modification=4.0 mol %, solid content=10% by mass) . . . 100 parts by mass
- Aqueous solution of adipic acid dihydrazide (solid content=10% by mass) . . . 10 parts by mass
- Aqueous solution of dioctyl sulfosuccinate (solid content=5% by mass) . . . 1 part by mass (6) Preparation of Coating Solution for Back Layer The following ingredients were mixed to prepare a coating solution for back layer.

- Kaolin filler . . . 100 parts
- Aqueous solution of diacetone-modified polyvinyl alcohol resin (degree of polymerization=2,000, degree of saponification=99.0%, degree of modification=4.0 mol %, solid content=10% by mass) . . . 100 parts Aqueous solution of adipic acid dihydrazide (solid content=10% by mass) . . . 10 parts Next, high-quality paper with 60 g/m$^2$ of basis weight was used as a substrate, and the coating solution for heat-sensitive color developing layer was applied onto the high-quality paper so as to be 0.5 g/m$^2$ of dried deposited amount of dye contained in the coating solution for heat-sensitive color developing layer, and it was dried, and then, a heat-sensitive color developing layer was formed. The coating solution for protective layer was applied onto this heat-sensitive color developing layer at coating speed of 800 m/min with a coater (Lab Coater CLC-6000 manufactured by Simu Tech International Inc.) so as to be 3.0 g/m$^2$ of dried deposited amount, and it was dried, and then, a protective layer was obtained. Further, the coating solution for back layer was applied onto the substrate surface, where no heat-sensitive color developing layer was arranged, so as to be 1.5 g/m$^2$ of dried deposited amount, and it was dried, and then, a back layer was formed. Thereafter, supercalender treatment was conducted to prepare a heat-sensitive recording material of Example 1.

Example 2

-Preparation of Heat-Sensitive Recording Material-

A heat-sensitive recording material of Example 2 was prepared as in Example 1 except for changing the aqueous solution of diacetone-modified polyvinyl alcohol resin (degree of polymerization=1,800, degree of saponification=97.5%, degree of modification=4.0 mol %, solid content=10% by mass) in the coating solution for protective layer in Example 1 to another aqueous solution of diacetone-modified polyvinyl alcohol resin (degree of polymerization=1,800, degree of saponification=94.5%, degree of modification=4.0 mol %, solid content=10% by mass).

Example 3

-Preparation of Heat-Sensitive Recording Material-

A heat-sensitive recording material of Example 3 was prepared as in Example 1 except for changing the aqueous solution of diacetone-modified polyvinyl alcohol resin (degree of polymerization=1,800, degree of saponification=97.5%, degree of modification=4.0 mol %, solid content=10% by mass) in the coating solution for protective layer in Example 1 to another aqueous solution of diacetone-modified polyvinyl alcohol resin (degree of polymerization=1,000, degree of saponification=97.5%, degree of modification=4.0 mol %, solid content=10% by mass).

Example 4

-Preparation of Heat-Sensitive Recording Material-

A heat-sensitive recording material of Example 4 was prepared as in Example 1 except for changing the aqueous solution of diacetone-modified polyvinyl alcohol resin (degree of polymerization=1,800, degree of saponification=97.5%, degree of modification=4.0 mol %, solid content=10% by mass) in the coating solution for protective layer in Example 1 into another aqueous solution of diacetone-modified polyvinyl alcohol resin (degree of polymerization=1,000, degree of saponification=94.5%, degree of modification=4.0 mol %, solid content=10% by mass).

Example 5

-Preparation of Heat-Sensitive Recording Material-

A heat-sensitive recording material of Example 5 was prepared as in Example 1 except for changing the aqueous solution of diacetone-modified polyvinyl alcohol resin (degree of polymerization=1,800, degree of saponification=97.5%, degree of modification=4.0 mol %, solid content=10% by mass) in the coating solution for protective layer in Example 1 to another aqueous solution of diacetone-modified polyvinyl alcohol resin (degree of polymerization=1,000, degree of saponification=96.5%, degree of modification=4.0 mol %, solid content=10% by mass).

Example 6

-Preparation of Heat-Sensitive Recording Material-

A heat-sensitive recording material of Example 6 was prepared as in Example 1 except for changing the aqueous solution of diacetone-modified polyvinyl alcohol resin (degree of polymerization=1,800, degree of saponification=97.5%, degree of modification=4.0 mol %, solid content=10% by mass) in the coating solution for protective layer in Example 1 to another aqueous solution of diacetone-modified polyvinyl alcohol resin (degree of polymerization=1,000, degree of saponification=95.5%, degree of modification=4.0 mol %, solid content=10% by mass).

Example 7

-Preparation of Heat-Sensitive Recording Material-

A heat-sensitive recording material of Example 7 was prepared as in Example 1 except for changing the aqueous solution of diacetone-modified polyvinyl alcohol resin (degree of polymerization=1,800, degree of saponification=97.5%, degree of modification=4.0 mol %, solid content=10% by mass) in the coating solution for protective layer in Example 1 to another aqueous solution of diacetone-modified polyvinyl alcohol resin (degree of polymerization=1,500, degree of saponification=96.5%, degree of modification=4.0 mol %, solid content=10% by mass).

Example 8

-Preparation of Heat-Sensitive Recording Material-

A heat-sensitive recording material of Example 8 was prepared as in Example 1 except for changing the aqueous solution of diacetone-modified polyvinyl alcohol resin (degree of polymerization=1,800, degree of saponification=97.5%, degree of modification=4.0 mol %, solid content=10% by mass) in the coating solution for protective layer in Example 1 to another aqueous solution of diacetone-modified polyvinyl alcohol resin (degree of polymerization=1,500, degree of saponification=95.5%, degree of modification=4.0 mol %, solid content=10% by mass).

Example 9

-Preparation of Heat-Sensitive Recording Material-

A heat-sensitive recording material of Example 9 was prepared as in Example 1 except for changing the aqueous solution of diacetone-modified polyvinyl alcohol resin (degree of polymerization=1,800, degree of saponification=97.5%, degree of modification=4.0 mol %, solid content=10% by mass) in coating solution for protective layer in Example 1 to another aqueous solution of diacetone-modified polyvinyl alcohol resin (degree of polymerization=1,700, degree of saponification=96.5%, degree of modification=4.0 mol %, solid content=10% by mass) and further changing the aqueous solution of diacetone-modified polyvinyl alcohol resin (degree of polymerization=2,000, degree of saponification=99.0%, degree of modification=4.0 mol %, solid content=10% by mass) in the coating solution for heat-sensitive color developing layer in Example 1 to another aqueous solution of diacetone-modified polyvinyl alcohol resin (degree of polymerization=1,700, degree of saponification=96.5%, degree of modification=4.0 mol %, solid content=10% by mass).

Example 10

-Preparation of Heat-Sensitive Recording Material-

A heat-sensitive recording material of Example 10 was prepared as in Example 1 except for changing the aqueous solution of diacetone-modified polyvinyl alcohol resin (degree of polymerization=1,800, degree of saponification=97.5%, degree of modification=4.0 mol %, solid content=10% by mass) in the coating solution for protective layer in Example 1 into another aqueous solution of diacetone-modified polyvinyl alcohol resin (degree of polymerization=1,700, degree of saponification=96.5%, degree of modification=4.0 mol %, solid content=10% by mass) and further changing the aqueous solution of diacetone-modified polyvinyl alcohol resin (degree of polymerization=2,000, degree of saponification=99.0%, degree of modification=4.0 mol %, solid content=10% by mass) in the coating solution for back layer in Example 1 to another aqueous solution of diacetone-modified polyvinyl alcohol resin (degree of polymerization=1,700, degree of saponification=96.5%, degree of modification=4.0 mol %, solid content=10% by mass).

Comparative Example 1

-Preparation of Heat-Sensitive Recording Material-

A heat-sensitive recording material for Comparative example 1 was prepared similarly to Example 1 except for changing the diacetone-modified polyvinyl alcohol resin solution (degree of polymerization=1,800, degree of saponification=97.5%, degree of modification=4.0 mol %, solid content=10% by mass) in the coating solution for protective layer in Example 1 to another aqueous solution of diacetone-modified polyvinyl alcohol resin (degree of polymerization=2,000, degree of saponification=99%, degree of modification=4.0 mol %, solid content=10% by mass).

Comparative Example 2

-Preparation of Heat-Sensitive Recording Material-

A heat-sensitive recording material of Comparative Example 2 was prepared as in Example 1 except for changing the aqueous solution of diacetone-modified polyvinyl alcohol resin (degree of polymerization=1,800, degree of saponification=97.5%, degree of modification=4.0 mol %, solid content=10% by mass) in the coating solution for protective layer in Example 1 to another aqueous solution of diacetone-modified polyvinyl alcohol resin (degree of polymerization=2,000, degree of saponification=89%, degree of modification=4.0 mol %, solid content=10% by mass).

Comparative Example 3

-Preparation of Heat-Sensitive Recording Material-

A heat-sensitive recording material of Comparative Example 3 was prepared as in Example 1 except for changing the aqueous solution of diacetone-modified polyvinyl alcohol resin (degree of polymerization=1,800, degree of saponification=97.5%, degree of modification=4.0 mol %, solid content=10% by mass) in the coating solution for protective layer in Example 1 to another aqueous solution of diacetone-modified polyvinyl alcohol resin (degree of polymerization=1,600, degree of saponification=98%, degree of modification=4.0 mol %, solid content=10% by mass).

Comparative Example 4

-Preparation of Heat-Sensitive Recording Material-

A heat-sensitive recording material for Comparative Example 4 was prepared as in Example 1 except for changing the aqueous solution of diacetone-modified polyvinyl alcohol resin (degree of polymerization=1,800, degree of saponification=97.5%, degree of modification=4.0 mol %, solid content=10% by mass) in the coating solution for protective layer in Example 1 to another aqueous solution of diacetone-modified polyvinyl alcohol resin (degree of polymerization=900, degree of saponification=99%, degree of modification=4.0 mol %, solid content=10% by mass).

Comparative Example 5

-Preparation of Heat-Sensitive Recording Material-

A heat-sensitive recording material of Comparative Example 5 was prepared as in Example 1 except for changing the aqueous solution of diacetone-modified polyvinyl alcohol resin (degree of polymerization=1,800, degree of saponification=97.5%, degree of modification=4.0 mol %, solid content=10% by mass) in the coating solution for protective layer in Example 1 to another aqueous solution of diacetone-modified polyvinyl alcohol resin (degree of polymerization=900, degree of saponification=89%, degree of modification=4.0 mol %, solid content=10% by mass).

For the binder resin in the coating solutions for protective layer in Examples 1 to 10 and Comparative Examples 1 to 5, values for the degree of polymerization, the degree of saponification, and the sheer speed at the inflection point of the viscosity change in the high shear speed region are shown in Table 1.

For the binder resin in the coating solutions for heat-sensitive color developing layer used in Examples 1 to 10 and Comparative Examples 1 to 5, values for the degree of polymerization, the degree of saponification, and the sheer speed at the inflection point of the viscosity change in the high shear speed region are shown in Table 2.

For the binder resin in the coating solutions for back layer used in Examples 1 to 10 and Comparative Examples 1 to 5, values for the degree of polymerization, the degree of saponification, and the sheer speed at the inflection point of the viscosity change in the high shear speed region of are shown in Table 3.

TABLE 1

| | Degree of polymerization | Degree of saponification (%) | Shear speed at inflection point of viscosity change ($sec^{-1}$) |
|---|---|---|---|
| Ex. 1 | 1800 | 97.5 | $1.02 \times 10^6$ |
| Ex. 2 | 1800 | 94.5 | $1.08 \times 10^6$ |

TABLE 1-continued

| | Degree of polymerization | Degree of saponification (%) | Shear speed at inflection point of viscosity change ($sec^{-1}$) |
|---|---|---|---|
| Ex. 3 | 1000 | 97.5 | $1.65 \times 10^6$ |
| Ex. 4 | 1000 | 94.5 | $1.75 \times 10^6$ |
| Ex. 5 | 1700 | 96.5 | $1.07 \times 10^6$ |
| Ex. 6 | 1700 | 95.5 | $1.33 \times 10^6$ |
| Ex. 7 | 1500 | 96.5 | $1.17 \times 10^6$ |
| Ex. 8 | 1500 | 95.5 | $1.41 \times 10^6$ |
| Ex. 9 | 1700 | 96.5 | $1.07 \times 10^6$ |
| Ex. 10 | 1700 | 96.5 | $1.07 \times 10^6$ |
| Comp. Ex. 1 | 2000 | 99.0 | $0.63 \times 10^6$ |
| Comp. Ex. 2 | 2000 | 89.0 | $0.82 \times 10^6$ |
| Comp. Ex. 3 | 1600 | 98.0 | $0.95 \times 10^6$ |
| Comp. Ex. 4 | 900 | 99.0 | None |
| Comp. Ex. 5 | 900 | 89.0 | None |

TABLE 2

| | Degree of polymerization | Degree of saponification (%) | Shear speed at inflection point of viscosity change ($sec^{-1}$) |
|---|---|---|---|
| Ex. 1 to 8 | 2000 | 99.0 | $0.63 \times 10^6$ |
| Ex. 9 | 1700 | 96.5 | $1.07 \times 10^6$ |
| Ex. 10 | 2000 | 99.0 | $0.63 \times 10^6$ |
| Compa. Ex. 1 to 5 | 2000 | 99.0 | $0.63 \times 10^6$ |

TABLE 3

| | Degree of polymerization | Degree of saponification (%) | Shear speed at inflection point of viscosity change ($sec^{-1}$) |
|---|---|---|---|
| Ex. 1 to 9 | 2000 | 99.0 | $0.63 \times 10^6$ |
| Ex. 10 | 1700 | 96.5 | $1.07 \times 10^6$ |
| Compa. Ex. 1 to 5 | 2000 | 99.0 | $0.63 \times 10^6$ |

Next, the obtained coating solutions for protective layer and the heat-sensitive recording materials were evaluated for various characteristics. The evaluation results are shown in Table 4. Further, the quality evaluation rank was evaluated from the evaluation results based upon the criteria mentioned below. The results are shown in Table 5.

[Evaluation Criteria]

A: Superior level in quality

B: Inferior but not problematic level in quality

C: Problematic level in quality

<(1) Coating Uniformity (Number of Waves)>

After application of each coating solution for protective layer, the number of occurrences of undulation, i.e., number of waves, was counted (waves/10 mm). No undulation (i.e., the number of occurrences of undulation is zero) means that the coating solution for protective layer has been applied uniformly. Meanwhile, when undulation occurs, the size of one wave becomes larger with increasing degree of unevenness; thus the fewer number of waves means increased degree of unevenness. Conversely, if the degree of undulation is small, waves become smaller and finer; thus the number of waves becomes greater.

<(2) Coating Uniformity (Visual Evaluation)>

After each coating solution for protective layer was applied, the degree of undulation was visually evaluated according to the following criteria:

[Evaluation Criteria]

4: No undulation occurred.

3: Slight unevenness occurred; however, no undulation was recognized, so it was not problematic.

2: Undulation occurred.

1: Undulation greatly occurred.

<(3) Front Surface Printability>

After printing was conducted onto the heat-sensitive surface of each heat-sensitive recording material at 50 m/min of printing speed using 1 ml of ultraviolet (UV) curable ink (Daicure EX-2 14 rouge B6, manufactured by Dainippon Ink and Chemicals, Incorporated) by a printability testing machine (RI-2 type, manufactured by Ishikawajima Industrial Machinery Co., Ltd.), the ink was cured by passing through a ultraviolet ray (UV) irradiator (Toscure 2000, manufactured by Toshiba Lighting & Technology Corporation) twice at 10 m/min of conveyance rate. After that, the print density was measured with a green filter of Macbeth densitometer RD-914.

<(4) Rear Surface Printability>

After printing was conducted onto the rear surface of each heat-sensitive recording material at 50 m/min of printing speed using 1 ml of ultraviolet (UV) curable ink (Daicure EX-2 14 rouge B6, manufactured by Dainippon Ink and Chemicals, Incorporated) by a printability testing machine (RI-2 type, manufactured by Ishikawajima Industrial Machinery Co., Ltd.), the ink was cured by passing through an ultraviolet ray (UV) irradiator (Toscure 2000, manufactured by Toshiba Lighting & Technology Corporation) twice at 10 m/min of conveyance rate. After that, the print density was measured with a green filter of Macbeth densitometer RD-914.

<(5) Maximum Color Density>

For the maximum color density of each heat-sensitive recording material, after printing was conducted with 0.20 ms to 1.20 ms of energy using a printing simulator (manufactured by Okura Electric Co., Ltd.), a maximum value for the density in the image portion was measured with a Macbeth densitometer RD-914.

<(6) Oil Resistance>

For the oil resistance of each heat-sensitive recording material, after an appropriate amount of cotton seed oil was coated onto the surface of the specimen where printing had been conducted with 1.00 ms of energy using a printing simulator (manufactured by Okura Electric Co., Ltd.), the density in the image portion after left standing at 40° C. for 24 hours was measured with a Macbeth densitometer RD-914.

<(7) Plasticizer to Resistance>

For the plasticizer resistance of each heat-sensitive recording material, after cellophane wrap made from a vinyl chloride resin containing a plasticizer was attached onto the surface of the specimen where printing had been conducted with 1.00 ms of energy using a printing simulator (manufactured by Okura Electric Co., Ltd.), the density in the image portion after left standing at 40° C. for 24 hours was measured with a Macbeth densitometer RD-914.

<(8) Water Resistance>

For the water resistance of each heat-sensitive recording material, the specimen, where printing had been conducted with 1.00 ms of energy using a printing simulator (manufactured by Okura Electric Co., Ltd.), was immersed into 100 mL of water for 24 hours under the environment at 20° C., the density in the image portion after testing was measured with a Macbeth densitometer RD-914.

TABLE 4

| | No. | | | | | | | |
|---|---|---|---|---|---|---|---|---|
| | (1) Coating uniformity (number of waves) | (2) Coating uniformity (visual evaluation) | (3) Printability (front surface) | (4) Printability (rear surface) | (5) Maximum color density | (6) Oil resistance | (7) Plasticizer resistance | (8) Water resistance |
| Ex. 1 | No undulation | 4 | 1.95 | 1.81 | 1.36 | 1.28 | 1.29 | 1.32 |
| Ex. 2 | No undulation | 4 | 1.96 | 1.82 | 1.37 | 1.29 | 1.29 | 1.33 |
| Ex. 3 | No undulation | 4 | 2.01 | 1.82 | 1.38 | 1.32 | 1.32 | 1.26 |
| Ex. 4 | No undulation | 4 | 2.00 | 1.82 | 1.38 | 1.32 | 1.33 | 1.28 |
| Ex. 5 | No undulation | 4 | 2.02 | 1.81 | 1.38 | 1.33 | 1.34 | 1.33 |
| Ex. 6 | No undulation | 4 | 2.01 | 1.81 | 1.38 | 1.32 | 1.34 | 1.33 |
| Ex. 7 | No undulation | 4 | 2.02 | 1.81 | 1.38 | 1.33 | 1.34 | 1.32 |
| Ex. 8 | No undulation | 4 | 2.02 | 1.81 | 1.38 | 1.32 | 1.34 | 1.33 |
| Ex. 9 | No undulation | 4 | 2.02 | 1.82 | 1.40 | 1.35 | 1.36 | 1.35 |
| Ex. 10 | No undulation | 4 | 2.01 | 1.90 | 1.38 | 1.32 | 1.34 | 1.32 |
| Comp. Ex. 1 | 4 | 1 | 1.80 | 1.81 | 1.34 | 1.23 | 1.22 | 1.31 |
| Comp. Ex. 2 | 6 | 2 | 1.82 | 1.82 | 1.35 | 1.22 | 1.21 | 1.30 |
| Comp. Ex. 3 | 7 | 2 | 1.88 | 1.82 | 1.35 | 1.25 | 1.24 | 1.31 |
| Comp. Ex. 4 | No undulation | 4 | 2.00 | 1.82 | 1.37 | 1.21 | 1.22 | 1.21 |
| Comp. Ex. 5 | No undulation | 4 | 2.01 | 1.80 | 1.38 | 1.22 | 1.23 | 1.20 |

TABLE 5

| | No | | | | | | | |
|---|---|---|---|---|---|---|---|---|
| | (1) Coating unevenness (number of waves) | (2) Coating uniformity (visual evaluation) | (3) Printability (front surface) | (4) Printability (rear surface) | (5) Maximum color density | (6) Oil resistance | (7) plasticizer resistance | (8) Water resistance |
| Ex. 1 | A | A | B | B | B | B | B | A |
| Ex. 2 | A | A | B | B | B | B | B | A |
| Ex. 3 | A | A | A | B | B | A | A | B |
| Ex. 4 | A | A | A | B | B | A | A | B |
| Ex. 5 | A | A | A | B | B | A | A | A |
| Ex. 6 | A | A | A | B | B | A | A | A |
| Ex. 7 | A | A | A | B | B | A | A | A |
| Ex. 8 | A | A | A | B | B | A | A | A |
| Ex. 9 | A | A | A | B | A | A | A | A |
| Ex. 10 | A | A | A | A | B | A | A | A |
| Comp. Ex. 1 | C | C | C | B | B | C | C | A |
| Comp. Ex. 2 | C | C | C | B | B | C | C | A |
| Comp. Ex. 3 | C | C | C | B | B | C | C | A |
| Comp. Ex. 4 | A | A | A | B | B | C | C | C |
| Comp. Ex. 5 | A | A | A | B | B | C | C | C |

According to the results in Table 4 and Table 5, since the specific diacetone-modified polyvinyl alcohol resins were used for the protective layer in each of the heat-sensitive recording materials for Examples 1 to 10, it was established that no undulation occurred upon application of coating solutions for protective layer, coating uniformity was excellent, no printing unevenness occurred, and barrier properties, such as oil resistance, water resistance, and plasticizer resistance, were excellent, compared to Comparative Examples 1 to 5.

With the heat-sensitive recording material for Example 9 where the diacetone-modified polyvinyl alcohol resin, which was the same as the one for the protective layer, was used for the heat-sensitive color developing layer, it was perceived that the undulating unevenness was restrained at the time of applying the heat-sensitive color developing layer and the maximum color density was excellent, compared to Examples 1 to 8 and 10 and Comparative Examples 1 to 5.

In addition, with the heat-sensitive recording material for Example 10 where the diacetone-modified polyvinyl alcohol, which was the same as the one for the protective layer, was used as the back layer, it was perceived that the undulating unevenness was restrained at the time of applying the back layer and it was excellent without causing the occurrence of printing unevenness on the rear surface, compared to Examples 1 to 9 and Comparative Examples 1 to 5.

The heat-sensitive recording material of the present invention does not cause the occurrence of printing nonuniformity; excels in the barrier properties, such as oil resistance and plasticizer resistance; and printability is excellent, for example, they are preferably used in various fields, such as a POS field, such as for perishable foods, packed lunches or prepared meals; a copying field, such as books or documents; a communication field, such as a facsimile; a ticketing field, such as ticket vending machines, receipts or vouchers; tags for baggage in the airline industry.

What is claimed is:

1. A heat-sensitive recording material, comprising:

a substrate;

a heat-sensitive color developing layer on the substrate, the heat-sensitive color developing layer containing at least a leuco dye and a developer; and a protective layer on the heat-sensitive color developing layer, the protective layer containing at least a binder resin, wherein the binder resin in the protective layer contains diacetone-modified polyvinyl alcohol resin, the degree of polymerization of the binder resin in the protective layer is 1,000 to 1,800 and the degree of saponification of the binder resin is 90% or greater and less than 98%.

2. The heat-sensitive recording material according to claim 1, wherein the degree of polymerization of the binder resin in the protective layer is 1,500 to 1,700 and the degree of saponification of the binder resin is 95% to 97%.

3. The heat-sensitive recording material according to claim 1 wherein the heat-sensitive color developing layer contains a binder resin, and the binder resin in the heat-sensitive color developing layer is the same as the binder resin in the protective layer.

4. The heat-sensitive recording material according to claim 1, wherein a back layer containing at least a binder resin is provided on a substrate surface where no heat-sensitive color developing layer is arranged, and the binder resin of the back layer is the same as the binder resin in the protective layer.

5. The heat-sensitive recording material according to claim 1, wherein the heat-sensitive recording material is a heat-sensitive recording label that includes a binding agent layer and a separation paper on a surface of the binding agent layer, the binding agent layer being provided on a substrate surface where no heat-sensitive color developing layer is arranged.

6. The heat-sensitive recording material according to claim 1, wherein the heat-sensitive recording material is a heat-sensitive recording label that includes a heat-sensitive binder layer that exhibits adhesiveness upon heated, the heat-sensitive binder layer being provided on a substrate surface where no heat-sensitive color developing layer is arranged.

7. The heat-sensitive recording material according to claim 1, wherein the heat-sensitive recording material is a heat-sensitive recording magnetic paper that includes a magnetic recording layer on a substrate surface where no heat-sensitive color developing layer is arranged.

8. A heat-sensitive recording material, comprising:

a substrate;

a heat-sensitive color developing layer on the substrate, the heat-sensitive color developing layer containing at least a leuco dye and a developer; and a protective layer on the heat-sensitive color developing layer, the protective layer containing at least a binder resin, wherein the binder resin of the protective layer contains diacetone-modified polyvinyl alcohol resin, and the shear speed at the inflection point of the viscosity change of a solution containing 13% by mass of solid contents of the binder resin in the protective layer in a high shear speed region in an environment of at 30° C. is $1.0\times10^{6}$ $sec^{-1}$ or greater.

* * * * *